US005099224A

United States Patent [19]

Santiago et al.

[11] Patent Number: 5,099,224

[45] Date of Patent: Mar. 24, 1992

[54] METHOD FOR IDENTIFYING MAGNETIC CHARACTERISTICS OF MAGNETIC ELEMENTS

[76] Inventors: Jesus C. P. Santiago, Condesa de Venadito 2, Madrid, Spain, 28027; Juan De La Cierva, Jr., Avenida de Buruos, 40-2A, Madrid, Spain, 28036

[21] Appl. No.: 638,588

[22] Filed: Jan. 8, 1991

[51] Int. Cl.[5] ..... G08B 13/24

[52] U.S. Cl. ..... 340/551; 340/572

[58] Field of Search ..... 324/239, 241, 243, 228, 324/261, 262, 308, 300; 340/551, 572, 825.31, 825.32

[56] References Cited

U.S. PATENT DOCUMENTS

| | | | |
|---|---|---|---|
| 3,763,424 | 10/1973 | Bennett, Jr. et al. | 340/551 |
| 4,398,149 | 8/1983 | Zens | 324/300 |
| 4,531,091 | 7/1985 | Kusenberger et al. | 324/243 |

*Primary Examiner*—Jin F. Ng
*Assistant Examiner*—C. Oda
*Attorney, Agent, or Firm*—Sanchelima & Assoc.

[57] ABSTRACT

A method for detecting and identifying the magnetic characteristics of materials by generating an interrogating electromagnetic field in which two opposing receiver antenna assemblies are immersed. The material is housed substantially within one of the receiver antenna assemblies so that one end protrudes slightly inside the other receiver antenna assembly to minimize edge effect noise. The responding field is detected, sampled and converted to a digital signal that is compared against pre-stored values that correspond to particular signatures or patterns of the materials being identified. Through computational adjustments of the digital values or adjustments to the interrogating field, the resulting digital values are fitted to the waveform patterns, within preestablished variances.

15 Claims, 3 Drawing Sheets

METHOD FOR IDENTIFYING MAGNETIC CHARACTERISTICS OF MAGNETIC ELEMENTS

II. BACKGROUND OF THE INVENTION

1. Field of the Invention.

The present invention relates to a novel method for detecting and identifying magnetic materials through their inherent magnetic characteristics or signatures, and more particularly, to a method that utilizes a uniform interrogating electromagnetic field in which said magnetic materials are immersed in a specific position.

2. Description of the Related Art.

Many systems have been developed in the past for the detection of specific magnetic materials when exposed to a zone where an interrogating electromagnetic field exists. These systems are extensively used in the electronic article surveillance (EAS) business. The interrogating electromagnetic field is generated so that it optimizes the detection of magnetic materials or "tags" thereby preventing the removal (shoplifting) of articles from a store. The most important performance characteristics of these systems are their selectivity and sensitivity. The selectivity characteristic requires that only the specific magnetic material or tag for which a system is designed to detect, is such that false alarms are minimized. It should be noted that some materials can fool such a system at least sometimes.

The other characteristic of these systems is their desired sensitivity so that the tag that carries the magnetic material will produce a field of sufficient intensity that it can be detected regardless of the position at which it crosses the aforementioned electromagnetic field. Most systems have spaces where the electromagnetic field is cancelled thereby forming "holes" where the magnetic material is not exposed to the necessary field intensity.

To optimize these characteristics, systems designed in the past have used active and passive tags as well as various types of fields such as low frequency, microwave, infrared and other electromagnetic fields in different areas of the spectrum. Some designs also use a combination of an electromagnetic field that activates a transducer resulting in a mechanical response in the audible range.

In other more popular systems the selectivity is based on the Fourier analysis of the responding field generated by the specific tag material when it enters the interrogating electromagnetic field. In these systems, the fundamental frequency used to generate the interrogating electromagnetic field activates the tag material which in turn produces a responding field. The responding field so generated is received through an antenna and then processed for the identification of the tag based on a Fourier analysis of the received signal. In this manner, the amplitude and/or phase of one or more of the harmonics of the fundamental electromagnetic field are obtained through the use of a variety of band pass filters, phase comparators, integrator circuits and voltage detectors. When the correct combination of amplitude and/or phase of one or several harmonics matches the corresponding field then a particular "signature" of a given magnetic element is identified.

III. SUMMARY OF THE INVENTION

It is one of the main objects of the present invention to provide a simple and reliable method for detecting and identifying magnetic elements or materials when exposed to a pre-determined interrogating electromagnetic field that causes these elements to respond with resulting electromagnetic fields that have specific waveform patterns that can be readily identified by comparing them to previously obtained waveform patterns for those magnetic elements.

It is another object of this invention to provide a method that includes the storage in digital memory of numerous waveform patterns by converting to a digital valve the detected analog voltage signal of the responding field of the magnetic element.

It is another object of this present invention to provide a method for identifying magnetic elements affixed to objects that can be positioned to expose said element to an interrogating field.

It is yet another object of this present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE PREFERRED EMBODIMENT

Figure 1:
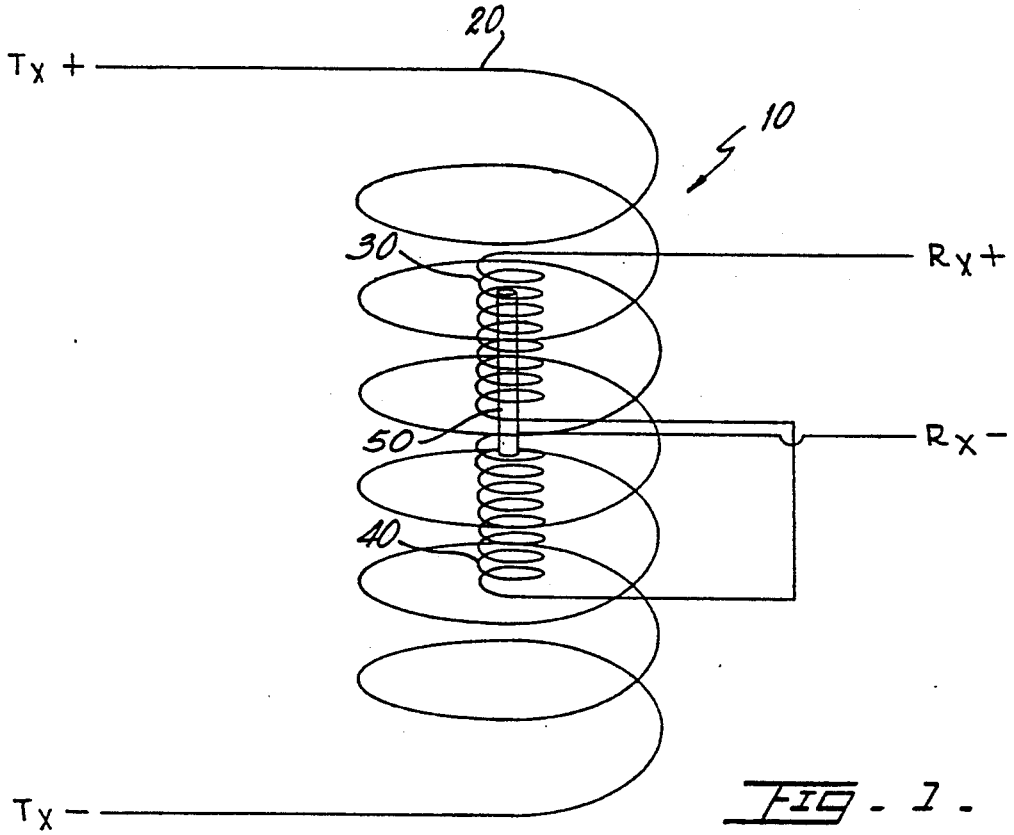
FIG. 1 is a representation of the transmitting and receiving antennas (coils) used to create the interrogating electromagnetic field in which the magnetic element to be identified is immersed, and to receive the responding electromagnetic field from the magnetic element through the use of receiver antennas connected in opposition.
Figure 3:
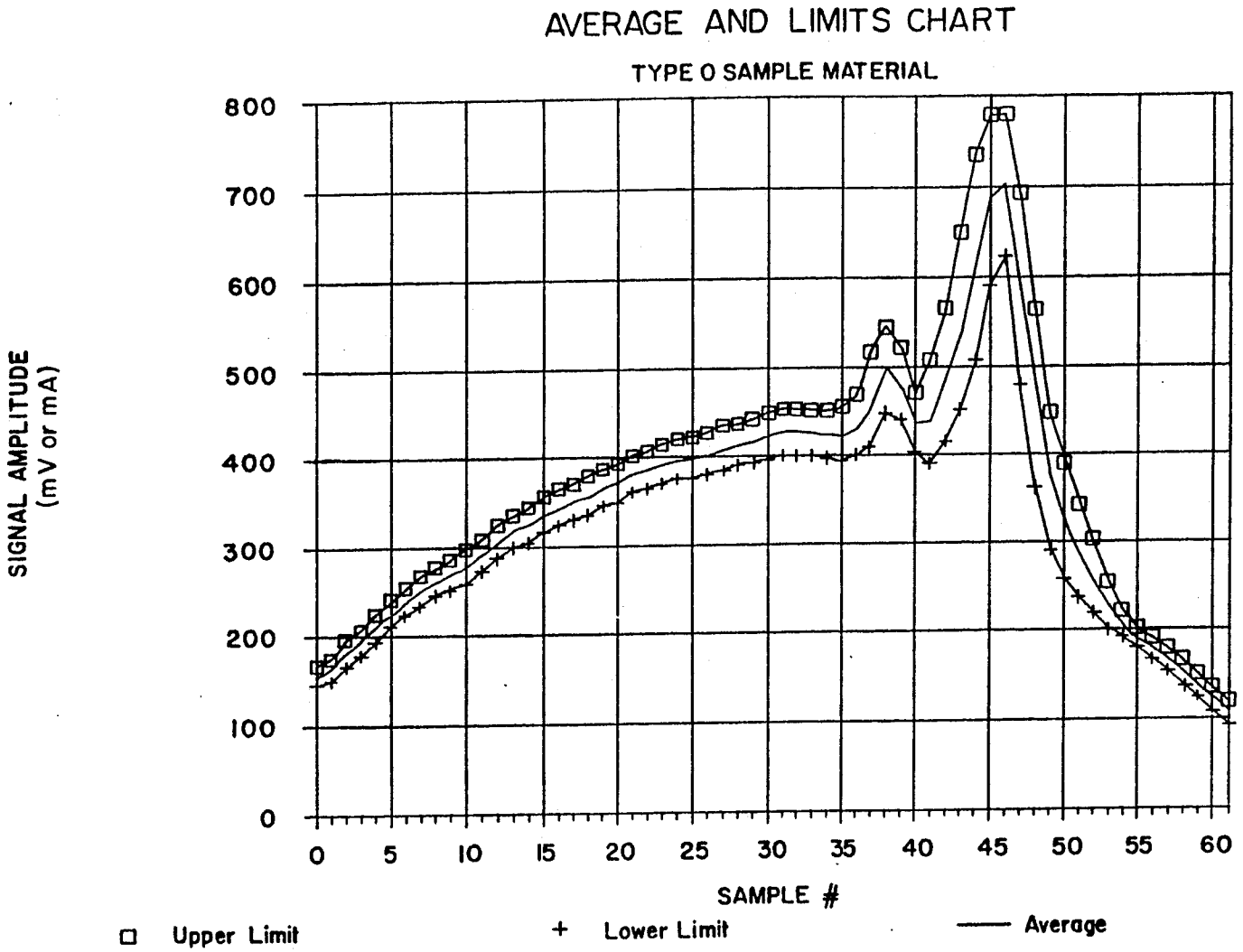
FIG. 3 shows the waveform pattern signature of a given magnetic element.
Figure 4:
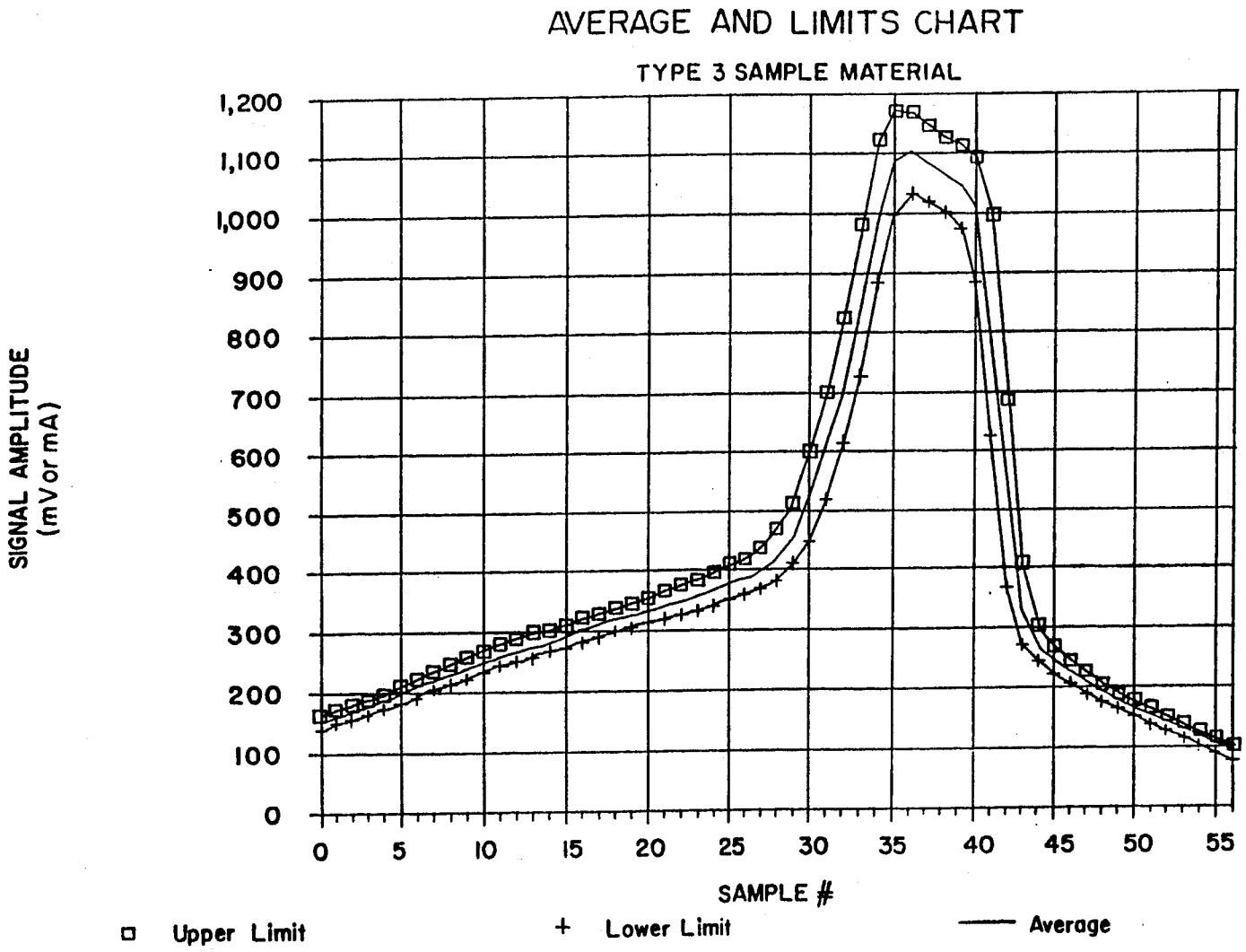
FIG. 4 illustrates the waveform pattern of another magnetic element different from the one illustrated in FIG. 2.

Referring now to FIG. 1, where the antennas of the present invention are generally referred to with numeral 10, it can be observed that it basically includes a transmitter antenna (coil) assembly 20 that houses two cancelling receiver antenna (coil) assemblies 30 and 40. As shown in FIG. 1, a transmitter antenna 20 transmits the interrogating electromagnetic field at a pre-determined frequency. Receiving antennas 30 and 40 are designed so that the emf induced by the interrogating field is cancelled out. In this manner, the resulting or responding field from magnetic material or material 50 can be detected and subsequently amplified, sampled and converted to a digital value proportional to the amplitude of the detected responding signal. The number of samples taken should be sufficient to provide a reasonably accurate pattern of the waveform over a period of time. In the preferred embodiment, sixty (60) samples per cycle were obtained as shown in FIGS. 3 and 4.

These sixty digital amplitude values $V_1$ through $V_{60}$ are stored in digital memory and subsequently, with a microprocessor device 70 and suitable software, each one of these sixty values is compared to sixty (60) pre-stored values $P_{1,1}$ through $P_{1,60}$, of the waveform pattern No. 1. If one of the detected values $V_1$ through $V_{60}$ does not fall within a predetermined variance from one of the corresponding pre-stored values of the first pattern being compared, namely, $P_{1,1}$ through $P_{1,60}$ then the software fetches the next pre-stored pattern values $P_{2,1}$ through $P_{2,60}$ and starts the same comparison procedure. This continues until all sixty sampled values fall within the predetermined variance for the values of one of the pre-stored patterns. It is to be understood that the predetermined variance (or window) is incorporated in the software program and it can be regulated to make the "matching" requirement more or less strict.

The pre-stored patterns' values $P_{i,1-60}$ are empirically determined by averaging out the amplitude values obtained from several batches of magnetic elements or materials with the same signatures. It has been found that these magnetic elements can be produced with sufficient repeatability that assures the reliability of the process. It is important to note that the specific positioning of the magnetic element 50 within receiving antenna assemblies 30 and 40 is such that element 50 is mostly housed within one of the receiving antennas 30 or 40, and the outwardly protruding end is housed within the other receiving antenna assembly 30 or 40, as shown in FIG. 1. This is necessary in order to avoid the noise effects of the edges of magnetic element 50.

Figure 2:
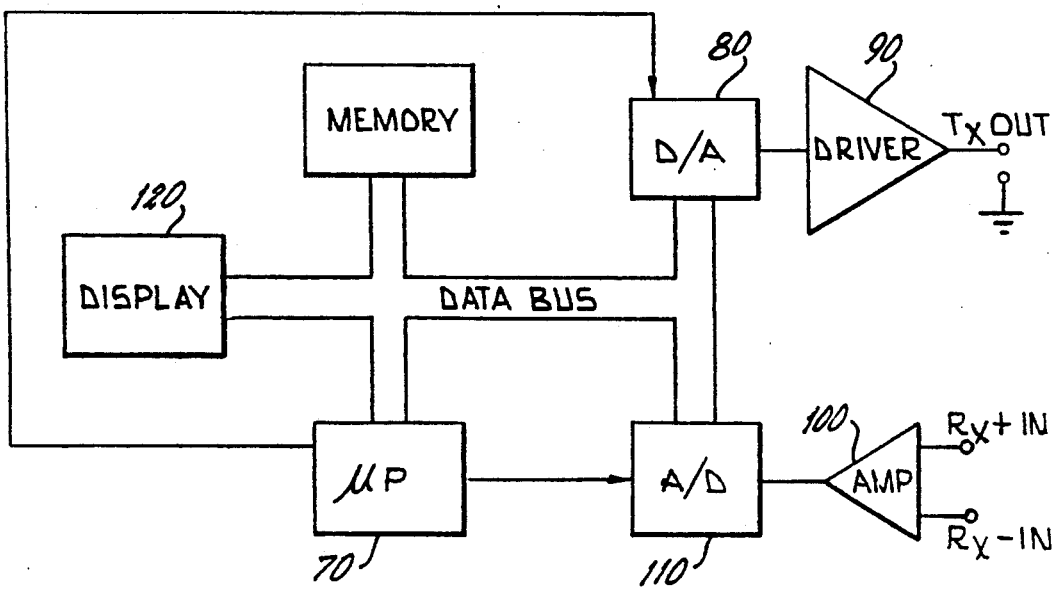
FIG. 2 illustrates a block diagram for the preferred embodiment of this invention.

Another important feature of this invention is that the interrogating field can be readily controlled and modified (in frequency and amplitude) through micro-processor device 70, as seen from the block diagram in FIG. 2. Micro-processor device 70 contains suitable program steps that will send the pertinent control signals to digital to analog converter circuitry 80 which in turn controls driver circuitry 90 that activates antenna assembly 10 at the selected frequency and amplitude. The signals received from receiver antenna assemblies 30 and 40 are applied to differential amplifier circuitry 100 and the resulting output fed to analog to digital circuitry 110 which in turn makes the converted digital signal available through the data to micro-processor device 70. Display assembly 120 provides the necessary means to indicate to the user what patterns, if any, have been identified.

It is also important to note that the amplitude of the received responding signal, or its equivalent value, is irrelevant. The important aspect is that as long as magnetic saturation of the material is achieved, the waveform is the same no matter what the amplitude of the interrogating and, consequently, the resulting fields are. Therefore, in making the comparison between the sampled values and the pre-stored values it is possible that the amplitude of the interrogating field is different than what was used to derive the pre-stored values initially. Any adjustment of this difference can be accomplished by either varying the amplitude of the interrogating field or by varying the converted sampled values uniformly and proportionally.

Under the first alternative, a user would generate an interrogating field with a larger or lower intensity and re-sample the resulting field with the subsequent conversion and comparisons to the pre-stored values of the different patterns.

A faster approach would be the second alternative wherein the sampled and digitally converted values are increased or decreased proportionally to approach the sampled values. If the adjusted values fail for all patterns, then it is adjusted again and the comparisons made again with the micro-processor. To compute the amount of the adjustment the difference between any one of the digital values and the corresponding pre-stored value can be used. The digital value will be adjusted so that it will approach by a certain predetermined percentage adjustment, the pertinent pre-stored value. This pre-determined value will be a coefficient that will be computed for each pattern and it will be used throughout for all pre-stored values for each pattern. The coefficient is computed by dividing one pre-stored value for a given pattern of waveform to its respective converted digital value thereby adjusting the difference between these two values to zero. Preferably, the software of device 70 will jump to a relatively far away sampled value to make the second comparison to its corresponding pre-stored value. In this manner, the likelihood of quickly determining whether it is the correct pattern is improved. If the second value does not fall within the variance permitted, then the next pattern is tested, for which another coefficient will have to be computed. If the second value falls within the prescribed variance, then the others will be tested. If none of the tested patterns falls within the predetermined variance, the tested material (magnetic or not) will be identified as "unknown".

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A method for identifying magnetic materials comprising the steps of:

A. generating an interrogating electromagnetic field;

B. positioning two receiving antenna assemblies within said interrogating electromagnetic field and said receiving antenna assemblies being connected in opposition to each other so that the responding electromagnetic field generated by said magnetic material is received by said receiving antenna assemblies;

C. detecting said responding electromagnetic field and amplifying the resulting electrical analog signal;

D. sampling said electrical analog signal at a predetermined sampling rate;

E. converting said sampled electrical analog signal to a digital value for each sample;

F. comparing said sampled digital values to pre-stored digital values;

G. computing the difference between each one of said sampled digital value and said pre-stored digital value;

H. determining whether each one of said differences fall within a predetermined variance;

I. indicating to user whether each one of said differences fall within said predetermined variance.

2. The method set forth in claim 1 further including the step of:

J. storing said digital values after they are converted from said sampled electrical analog signal.

3. The method set forth in claim 2 wherein the event that at least one of said digital values does not fall within variance all of said digital values are varied uniformly and proportionally by a calculated coefficient that will zero the difference computed between any one of said digital values and its corresponding pre-stored value wherein said coefficient is the ratio of said pre-stored value to said digital value.

4. The method set forth in claim 2 further including the step of:

K. comparing said digital values to the corresponding pre-stored values of additional patterns in the event that one of said digital values does not fall within said variance of the previous pattern.

5. The method set forth in claim 4 wherein the event that at least one of said digital values for each one of said patterns do not fall within said variance, the method includes the step of varying all of said digital values uniformly and proportionally by a calculated coefficient that will zero the difference computed between any one of said digital values and its corresponding pre-stored value wherein said coefficient is the ratio of said pre-stored value of a given pattern to said digital value.

6. The method set forth in claim 1 wherein said magnetic material has two ends and said magnetic material is substantially housed within one of said two receiver antenna assemblies and one of the ends of said magnetic material protrudes slightly inside the other receiver antenna assembly.

7. The method set forth in claim 2 wherein said interrogating electromagnetic field can be varied in frequency.

8. The method set forth in claim 3 wherein said interrogating electromagnetic field can be varied in amplitude.

9. A method for identifying magnetic materials, having two ends, comprising the steps of:

A. generating an interrogating electromagnetic field;

B. positioning two receiving antenna assemblies within said interrogating electromagnetic field and said receiving antenna assemblies being connected in opposition to each other so that the responding electromagnetic field generated by said magnetic material is received by said receiving antenna assemblies and said magnetic material is substantially housed within one of said two receiver antenna assemblies and one of the ends of said magnetic material protrudes slightly inside the other receiver antenna assembly;

C. detecting said responding electromagnetic field and amplifying the resulting electrical analog signal;

D. sampling said electrical analog signal at a predetermined sampling rate;

E. converting said sampled electrical analog signal to a digital value for each sample;

F. comparing said sampled digital values to pre-stored digital values;

G. computing the difference between each one of said sampled digital value and said pre-stored digital value;

H. determining whether each one of said differences fall within a predetermined variance;

I. indicating to user whether each one of said differences fall within said predetermined variance.

10. The method set forth in claim 9 further including the step of:

J. storing said digital values after they are converted from said sampled electrical analog signal.

11. The method set forth in claim 10 wherein the event that at least one of said digital values does not fall within said variance all of said digital values are varied uniformly and proportionally by a calculated coefficient that will zero the difference computed between any one of said digital values and its corresponding pre-stored value wherein said coefficient is the ratio of said pre-stored value to said digital value.

12. The method set forth in claim 10 further including the step of:

K. comparing said digital values to the corresponding pre-stored values of additional patterns in the event that one of said digital values does not fall within said variance of the previous pattern.

13. The method set forth in claim 12 wherein the event that at least one of said digital values for each one of said patterns do not fall within said variance, the method includes the step of varying all of said digital values uniformly and proportionally by a calculated coefficient that will zero the difference computed between any one of said digital values and its corresponding pre-stored value wherein said coefficient is the ratio of said pre-stored value of a given pattern to said digital value.

14. The method set forth in claim 9 wherein said interrogating electromagnetic field can be varied in frequency.

15. The method set forth in claim 9 wherein said interrogating electromagnetic field can be varied in amplitude.

* * * * *